US005842654A

United States Patent [19]

Schenk

[11] Patent Number: 5,842,654

[45] Date of Patent: Dec. 1, 1998

[54] DEVICE FOR FIXING A PARTITION FOR TUBE MILL AND METHOD FOR THIS PURPOSE

[75] Inventor: Albert Schenk, Francorchamps-Stavelot, Belgium

[73] Assignee: Slegten Societe Anonyme, Louvain-La-Neuve, Belgium

[21] Appl. No.: 910,860

[22] Filed: Aug. 13, 1997

Related U.S. Application Data

[63] Continuation of Ser. No. 537,787, filed as PCT/EP94/01119, Apr. 8, 1994, published as WO94/25164, Nov. 10, 1994, abandoned.

[30] Foreign Application Priority Data

Apr. 23, 1993 [EP] European Pat. Off. ..... 93870069

[51] Int. Cl.[6] ..... B02C 17/14

[52] U.S. Cl. ..... 241/171

[58] Field of Search ..... 29/525.02, 525.11, 29/527.5, 530, 895.21, 895; 492/38, 39; 241/181, 182, 183, 171

[56] References Cited

U.S. PATENT DOCUMENTS

| | | | |
|---|---|---|---|
| 3,298,619 | 1/1967 | Verch | 241/179 |
| 3,799,458 | 3/1974 | Lutke-Cossmann | 241/171 |
| 4,141,511 | 2/1979 | Anderson | 241/183 |
| 4,165,041 | 8/1979 | Larsen | 241/182 |
| 4,498,634 | 2/1985 | Nelson et al. | 241/72 |
| 4,609,158 | 9/1986 | Wilson | 241/182 |
| 4,668,183 | 5/1987 | Patterson | 241/183 |
| 5,292,077 | 3/1994 | Inui et al. | 241/171 |
| 5,431,351 | 7/1995 | Lejonklou | 241/183 |
| 5,516,051 | 5/1996 | Brisbois et al. | 241/183 |

FOREIGN PATENT DOCUMENTS 0 504 041 9/1992 European Pat. Off. .

*Primary Examiner*—Joseph M. Gorski
*Assistant Examiner*—Tisa Stewart
*Attorney, Agent, or Firm*—Jacobson, Price, Holman & Stern, PLLC

[57] ABSTRACT

The invention relates to a novel device for fixing a partition to a shell (4) of a tube mill in which the partition comprises a cast framework (1), in steel or in cast iron consisting of several sectors (15) provided with a set of fixing holes (32) in their peripheral face (3), each sector (15) being independent of the other sectors, characterized in that it possesses an annular intermediate baseplate (100) arranged facing the said shell (4), providing a space between the shell (4) and the intermediate baseplate (100), which space is chosen so that the inner face of the intermediate baseplate (100) forms a reference surface at the nominal diameter of the periphery of the said cast sectors (15), this space being set with the aid of adjustment elements (110) and the intermediate baseplate (100) being provided with holes (102) which can be matched to the said set of fixing holes (32) in the peripheral face (3) of the sectors (15) in order to enable the latter to be fixed by means of bolts in the holes of the intermediate baseplate (100), means (101, 41, 42) being provided for rigidly fastening the intermediate baseplate (100) to the shell (4). The invention also relates to the method for the operation of the device.

5 Claims, 2 Drawing Sheets

DEVICE FOR FIXING A PARTITION FOR TUBE MILL AND METHOD FOR THIS PURPOSE

This application is a file wrapper continuation of application Ser. No. 08/537,787, filed as PCT/EP94/01119 Apr. 8, 1994, published as WO94/25164 Nov. 10, 1994, now abandoned.

BACKGROUND OF ONE INVENTION

The present invention relates to tube mills with grinding balls or similar grinding members, comprising at least two grinding compartments separated by a partition. These tube mills work by dry or wet processing and are intended, by way of example, for the grinding of cement.

The subject of the present invention relates more particularly to a device for fixing a partition to the shell of a tube mill and to a method for the implementation of the device.

STATE OF THE ART

The main role of the partitions which separate two successive compartments of a tube mill is to keep the grinding bodies in the ad hoc grinding compartments—taking into account their dimensions—preventing them from passing from one compartment to the other.

These partitions are furthermore intended to screen the ground matter, allowing only the sufficiently fine particles to pass towards the downstream compartment.

The above functions may be achieved with single-walled or double-walled partitions. Currently, it is mainly double-walled partitions which are used since they have a longer lifetime and their resistance to in-service stresses is better.

In most cases, partitions of this type include a frame consisting of several sectors to which grilles are fixed upstream, these grilles enabling the sufficiently ground material to pass downstream and downstream of the lining plates which provide a central discharge opening for the material to pass to the downstream compartment.

The grilles and the lining plates which are called wear pieces are fixed by bolting to the frame.

It is usual to produce the wear pieces from steel having a very high hardness so that they can withstand the impacts of the grinding bodies and the wear caused by the ground material (abrasion) for a sufficiently long time.

The frame supporting the wear pieces must have good properties in terms of abrasion, corrosion and temperature. The reason for this is that the matter to be ground may be of various shapes and, in particular, in the case of a wet process, in the form of a paste which is abrasive, corrosive and having a density greater than 1. The working conditions of the frame are then particularly harsh.

That being so, it has been proposed firstly to produce the frame in cast steel or in cast iron. It thus has a sufficient abrasion resistance.

However, the frame must be able to be inserted into the tube mill, and, consequently, it must consist of several sectors having sufficiently small dimensions so as to be able to pass through the inspection doors or through the inlet throat.

Document U.S. Pat. No. 1,787,897 describes a partition frame or framework. This framework is conventionally in the form of a torus, the axis of which corresponds to the axis of the tube mill and the external cylindrical surface of which faces the internal cylindrical surface of the shell of the tube mill. The two, upstream and downstream, annular faces are perpendicular to the axis and respectively support the grilles and the lining pieces.

The grilles are pierced by openings or slots so as to allow the ground matter to penetrate into the torus and it is subsequently extracted through a central opening of the downstream face of the partition.

The torus of the framework is divided radially into sectors, the dimensions of which are defined so as to enable them to be inserted into the mill through the doors or the inlet throat.

The division of the sectors is also chosen depending on the drill-holes existing in the shell of the tube mill. Each sector of the framework must be an integral divisor of the number of drill-holes which the tube mill possesses on its circumference. This enables each sector to be fixed to the inner face of the shell of the tube mill by simply bolting each sector to the shell.

Nevertheless, this type of construction is used particularly in the case where the dimensions of the mills remain limited. During the last few decades, the diameter of tube mills has virtually doubled. As a result, problems have arisen concerning resistance to the stresses generated by the increasing deformation of the tube mills and by the lack of impact strength of the cast alloys. Furthermore, difficulties of assembly on site have arisen. As a result, the frames produced in cast steel or in cast iron have been progressively replaced by frameworks produced from rolled steel which are mechanically joined and/or welded.

Document DE-A-2,133,431 describes mechanically joined and/or welded frameworks which have a structural design similar to the cast frameworks. In particular, the various sectors constituting the frame are bolted by their peripheral baseplates directly to the shell of the tube mill.

Document U.S. Pat. No. 3,776,477 describes a particular example of a frame for partitions produced from mild steel, this frame being assembled by welding. Indeed, mild steel has properties which facilitate the welding of the pieces to each other. In this document, a partition is described which comprises a ring, the cross-section of which is in the form of a U-bar and which bears directly on the shell of the tube mill. This ring is therefore fixed directly to the shell and is composed of several segments so as to be able to be inserted through the inspection doors into the tube mill. A disc, possessing a central circular opening, also consisting of several elements is fixed to that flange of the U of the ring which is downstream with respect to the flow of matter. The elements of the disc are fixed to the segments of the ring either by welding or by bolting. Next, radial blades having a T-shaped cross-section are welded on site to the peripheral ring and to the downstream disc, the web of the T being placed perpendicular to the disc.

Nevertheless, the frameworks produced from mild steel do not withstand the corrosion and high abrasion for a sufficiently long time; in some cases, they have lifetimes shorter than those of the wear pieces. Various means have been envisaged for improving their resistance. In particular, the use of stainless steel has been envisaged, likewise the coating with rubber of the various parts constituting the frame has been proposed. But none of these solutions enables the problem of abrasion to be solved. The reason for this is that, in order to produce a construction from rolled stainless steel which is welded on site without a final heat treatment, it is necessary to use a rolled stainless steel of low hardness. Moreover, rubber cannot be used in dry processing when the in-service temperatures are too high for the material.

Moreover, in order to solve the problem of abrasion, it has been envisaged to produce the frame from rolled steel of high hardness, but the cost of producing the welds and the heat treatments increases the manufacturing costs excessively. This approach consequently constitutes only a partial solution, while increasing the cost of producing the framework excessively.

Finally, the numerous elements can be accurately joined and welded on site only with difficulty. The reason for this is that the elements have to be welded without the possibility of a subsequent correction and without having available a real reference surface, except for the the tube itself which is not, however, calibrated.

Furthermore, it should be noted that the assembly of the various pieces constituting the partition must be so accurate that no opening greater than the maximum dimension of the slots existing in the grilles can appear (in general, these slots are less than 6 mm). The minimum assembly gaps, added to the manufacturing tolerances, cannot exceed the maximum dimensions of the slots existing in the grille. A A recent approach consists in producing cast frameworks, as was the case for partitions intended for small-diameter tube mills, but with steels having high hardness (ERC greater than 35) and, preferably, stainless steels.

Current foundry techniques make it possible to choose alloys suitable for resisting corrosion and to heat-treat them so as to obtain mechanical characteristics suitable for resisting abrasion. Furthermore, foundry techniques currently make it possible to design very diverse shapes easily and, in particular, shapes which are suitable for resisting the mechanical stresses.

Nevertheless, the classical problem of the insertion of the framework into the tube mill can only be solved by segmenting the framework so that the maximum dimensions of the various sectors is less than the dimension of the inspection doors or of the throats. These sectors must therefore be fixed to the shell of the tube mill by an integral and sufficient number of fixing points. This implies that the number of drill-holes in the shell, in order to enable the fixing to be carried out, must be a multiple of the number of sectors of which the framework of the partition is composed, the said number of sectors being defined by the maximum dimensions of each of them, these being less than the dimension of the doors or of the throats.

Although the diameters of the various mills have been standardized by all constructors in the various measurement systems, this is not the case as regards the number of drill-holes in the shell of the tube mill and as regards the dimensions of the various accesses into the mill. Consequently, it is not economically possible to deal with all mills of a given diameter following the standards specific to each constructor, as this would lead to the creation of too great a number of foundry patterns for the construction of the sectors of the framework, which would render the use of castings for the frame unprofitable. The ideal would be to be free of the constraints which lead to the numerous standards as regards the drill-holes so as to have to create only a single sector pattern per proposed diameter of tube mill, and which can be inserted through the smallest accesses.

SUMMARY OF THE INVENTION

The present invention aims to provide a partition-fixing device for a tube mill; the partition including a framework produced from a cast material, which is in the form of a juxtaposition of several sectors, in such a way that, for each diameter of a tube mill, a limited number of foundry patterns, or indeed just a single one, is constructed, and this being so independently of the standards relating to the drill-holes and the dimensions of the inspection doors of the mill.

The present invention consequently aims to provide a solution when the fixing means existing at the periphery of the sectors cannot be matched to the drill-holes of the shell of the tube mill.

In a complementary way, the present invention aims for the various sectors constituting the framework of a partition to be assembled with accurate setting and adjustment, which prevents the appearance of openings of a dimension greater than the maximum dimension of the existing slots.

The present invention relates to a device for fixing a partition to a shell of a tube mill, in which the partition comprises a cast framework, in steel or in cast iron, consisting of several sectors provided with a set of fixing holes in their peripheral face, each sector being independent of the other sectors the space between said device and the shell being pulled up with adjustment elements and with cast metal melting at low temperature characterized in that it possesses an annular intermediate baseplate composed of several segments joined together so as to constitute a monobloc baseplate and which is arranged facing the shell, providing a space between the shell and the intermediate baseplate, this space being chosen so that the inner face of the intermediate baseplate forms a reference surface at the nominal diameter of the periphery of the said cast sectors, the intermediate baseplate being provided with holes which can be matched to the set of fixing holes of the peripheral face of the sectors in order to enable the latter to be fixed by bolts in the holes of the intermediate baseplate, means being provided for rigidly fastening the intermediate baseplate to the shell.

The external diameter of the intermediate baseplate is chosen to be able to be fitted easily into a tube mill of a given diameter which differs from the nominal diameter by the value of the manufacturing tolerances.

This is why a space is provided between the intermediate baseplate and the shell; it is thus possible to produce the intermediate baseplate to the same diameter for all the shells of a given nominal diameter.

Advantageously, the intermediate baseplate, which has a relatively small cross-section, is cut up into three or four segments in order to be able to be inserted into the shell through the access point of the tube mill. These segments are subsequently welded, when fitting, so as to form a monobloc intermediate baseplate.

The adjustment elements which fill the space between the intermediate baseplate and the shell may be made up of a cast metal melting at low temperature, such an zinc. The metal melting at low temperature may constitute the means for rigidly fastening the intermediate baseplate to the shell.

The intermediate baseplate, being fitted to a precise internal diameter, may serve as a reference surface. The sectors of the framework are subsequently fixed to the intermediate baseplate; their installation no longer requires particular positioning precaution because of the very presence of the intermediate baseplate as a reference surface.

As a consequence, advantageously, it in observed that the partitions installed according to the fixing method described hereinabove in general have no inopportune opening which would enable poorly ground matter to pass from one compartment to the other.

According to a first preferred embodiment, the intermediate baseplate is fixed by bolting, on the one hand, to the shell of the tube mill and, on the other hand, to the various sectors.

Thus, the intermediate baseplate possesses, on its outer face, a series of holes intended for fixing it to the shell of the tube mill, these holes being able to be matched to the drill-holes in the shell of the tube mill which are determined by the constructor of the said tube, and another series of holes, which are tapped and which can be matched to the precise arrangement of the holes for fixing the sectors.

In general, it is only necessary to create one particular type of baseplate for each type of construction of a defined tube mill. Nevertheless, this enables all the castings to be calibrated and, especially, the sectors of the partitions may be cast solely as a function of the diameter of the intermediate baseplate and therefore of the nominal diameter of the mill and no longer as a function of each type of drill-hole in the tube mill.

According to a preferred embodiment, the intermediate baseplate consists of a rolled steel sheet, the composition of which may be chosen so as to resist corrosion and abrasion. This sheet has the advantage of being able to be easily worked, in particular bent and drilled.

According to another preferred embodiment, the protection of the intermediate baseplate from abrasion may be achieved by creating sectors the base of which covers the intermediate baseplate entirely. Parts projecting from the wear pieces may be provided so as to protect the intermediate baseplate laterally.

This makes it possible to have to produce only a single foundry pattern for sectors corresponding to a given diameter of the tube mill.

Other objects and advantages will be described by means of the preferred embodiment referred to above.

DESCRIPTION OF A PREFERRED EMBODIMENT

Figure 1:
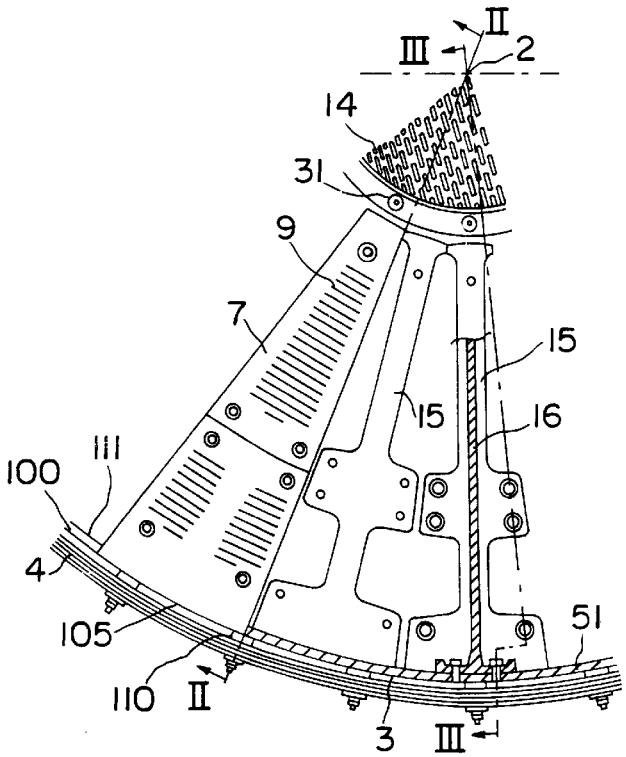
FIG. 1 represents a partial section of the mill perpendicular to its axis, the grinding balls and the shell linings having been removed; the section shows a partition provided with the fixing device according to the invention, seen from the inlet of the mill, part of the grilles having been removed in order to show two sectors constituting the framework of the partition, and the front face of one of the two sectors having been cut away in order to show part of the lifting device and the peripheral face of the sector.

The fixing device described relates to a partition fitted between two grinding compartments of a rotary ball mill.

The partition comprises a framework which is in the form of a torus (1), the axis (2) of which corresponds to the axis of the tube mill and the external cylindrical surface (3) of which faces the internal cylindrical surface of the shell (4) of the tube mill.

The two annular faces (5) and (6), upstream and downstream with respect to the forward movement of the matter, are perpendicular to the axis (2) of the mill and respectively support the grilles (7) and the lining plates (8). The grilles (7) are pierced by openings (9) called slots which enable the ground matter to penetrate into the torus (1). This matter is subsequently extracted through a central opening (10) existing on the downstream face of the partition.

Figure 2:
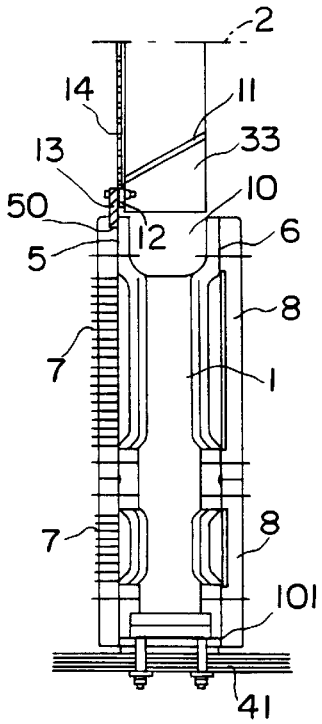
FIG. 2 represents a sectional view of the partition in a plane passing through the axis of the mill along the line II—II of FIG. 1.

According to the preferred embodiment shown in FIG. 2, the central opening (10) appearing on the side of the downstream face (6) of the framework comprises a truncated cone (11) coaxial with the torus (1) and the top of which is directed towards the downstream compartment.

The torus (1) of the framework is divided regularly into a certain number of sectors (15), the dimensions of which are defined so as to enable them to be inserted into the mill through the inspection doors or through one of the throats. The sectors (15) of the framework are produced in cast steel or in cast iron.

During the rotation of the mill, the shell deforms and its various sections become oval due to the effect of the movements of the grinding charges and the same applies to the cross-section of the shell where the partition is located. It is necessary for the partition to be produced so as to withstand these deformations: this is the reason why the various sectors constituting the framework are independent; this enables them to move further apart or closer together without the ovalization of the shell creating stresses in the framework.

This is also the reason why the truncated cone (11) is not fixed to the sectors but by means of its flange (12) to an annular flange (13) housed freely in an annular groove (50) in the grilles (7). A screen (14), intended for preventing the grinding bodies or the insufficiently ground particles from passing, closes the opening of the truncated cone and is held fast between the flange (13) and the flange (12) of the truncated cone.

In FIG. 1, grilles (7) have been fixed to the upstream face of the framework by means of bolts and two grilles have been removed so as to show the upstream face of a sector of the framework.

These sectors are provided with holes intended to receive the bolts which fix, on the one hand, the grilles (7) to the upstream face and, on the other hand, the lining plates (8) to the downstream face. The upstream and downstream faces of the sectors are widened right opposite the bolts so as to ensure that the grilles are seated correctly.

They also comprise radial blades (16) which form the web of the sectors and which extend from the periphery of the partition constituted by the external cylindrical surface (3) produced as far as the central part of the sectors. These blades are intended, by virtue of the rotation of the mill, to transport the ground matter which penetrates into the torus (1) of the partition from the said periphery of this partition towards the central cone where this ground matter flows out into the downstream compartment of the mill. These blades furthermore ensure the rigidity of the sectors (15) against the axial thrusts exerted by the grinding balls which partially fill the upstream and downstream grinding compartments contiguous with the partition.

In order to prevent the upstream and downstream faces of the sectors from masking the slots of the grilles and from thus reducing the flow of matter or the passage of ventilation air, the blades have a smaller width outside the zones for seating the grilles and the upstream and downstream faces of the sectors are not planar but follow the contour of the lifting devices.

According to the present invention, a monobloc annular intermediate baseplate (100) is arranged facing the shell (4), allowing a gap (105) to remain between the baseplate and the shell and setting this gap by means of adjustment elements (110) so that the internal surface (111) of the baseplate constitutes a reference surface exactly at the nominal diameter of the periphery of the sectors. The space (112), which remains between the shell, the baseplate and the adjustment elements, may subsequently be filled up by means of a cast metal melting at low temperature.

Advantageously, the intermediate baseplate (100) consists of several segments, generally three or four, which enables them to be easily inserted through the accesses into the tube mill.

After fixing the various segments to the shell of the tube mill, these segments are welded, at 51, so as to form a monobloc closed ring.

Advantageously, the intermediate baseplate (100) consists of a rolled steel sheet, the composition of which may be chosen so as to resist corrosion.

This implementation has the advantage of enabling the sheet to be drilled and shaped easily using sheet-metal-working techniques, and this may be done depending on the individual requirements of each tube mill, for example depending on the drill-holes existing in the shell and the drill-holes existing at the periphery of the cast sectors.

The sectors possess a U-shaped foot (17), the external cylindrical surface (3) of which faces the internal cylindrical surface of the baseplate.

Figure 4:
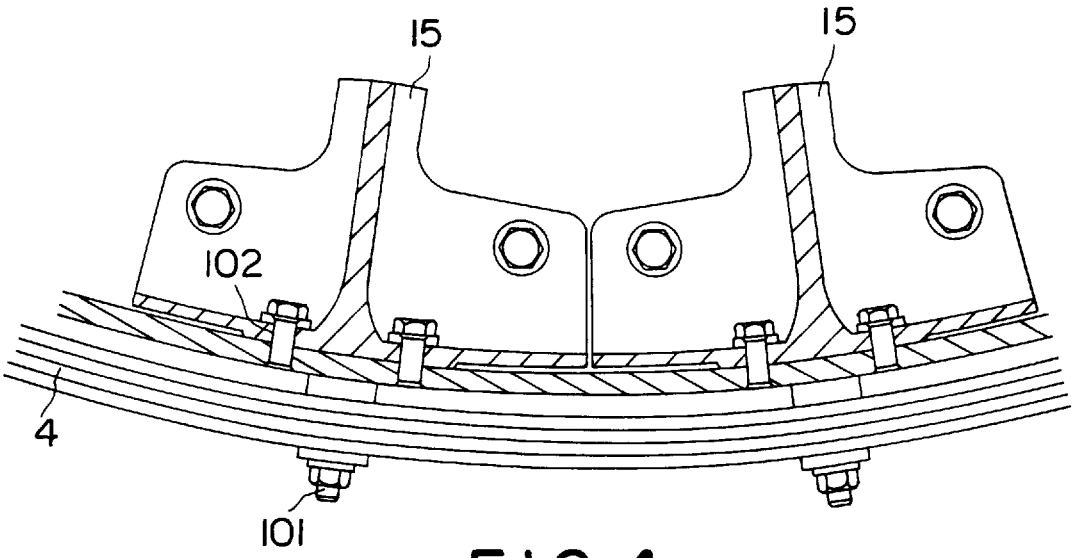
FIG. 4 represents the feet of two contiguous sectors, the upstream face of which has been cut away and the external cylindrical surface of which covers the intermediate baseplate entirely.

According to another embodiment shown in FIG. 4, the intermediate baseplate will be completely protected by the juxtaposition of the sectors.

Figure 3:
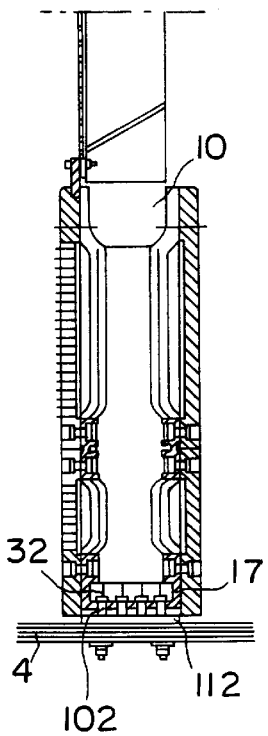
FIG. 3 represents a sectional view of the partition in a plane passing through the axis of the mill along the line II—II of FIG. 1.

As may be seen in FIGS. 2 and 3, a part projecting from the pieces constituting the grilles (7) and the lining plates (8) fixed to the sectors of the framework is provided in order to protect the baseplate laterally.

This intermediate baseplate has, on the one hand, a series of holes (101) intended to match the drill-holes (41) existing in the shell of the tube mill and bolting fixes the baseplate to the shell. The peripheral face of the No. X sectors is provided with X holes intended to match the X threaded holes of the intermediate baseplate, bolts 32 fixing the sectors to the baseplate.

According to another embodiment (not shown), the holes (101) existing in the intermediate baseplate in order to fix it to the shell are tapped so as to enable bolts to be screwed into them, the heads of the bolts lying outside the shell (4).

Figure 5:
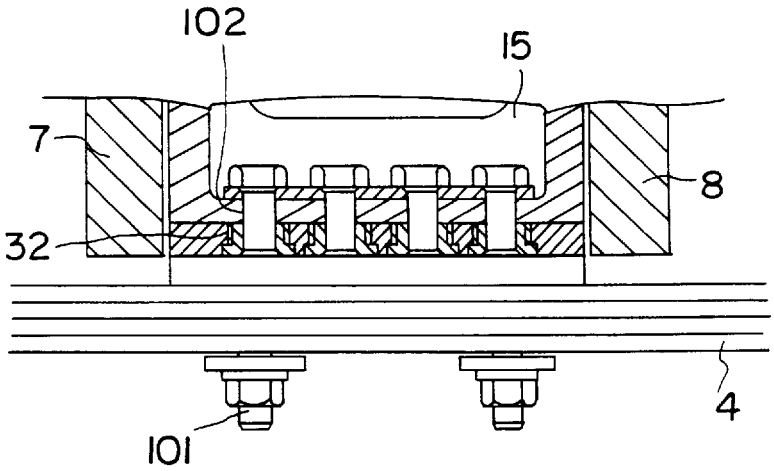
FIG. 5 represents a tapped added piece fixed into the intermediate baseplate.

According to another embodiment shown in FIG. 5, the tapped holes (102) existing in the baseplate are formed by added pieces. For the clarity of FIG. 5, the fourth bolt (32) has been withdrawn.

According to another embodiment (not shown), the metal melting at low temperature, inserted into the space (112) existing between the baseplate and the shell, rigidly fastens the baseplate to the shell.

It is quite obvious that the present invention is described for one particular embodiment of a partition, but it may be extended to other types of partitions.

I claim:

1. A frame in combination with a tube mill, comprising a cast framework of one of steel or iron, consisting of several sectors, each of said sectors having a peripheral face and a set of fixing holes in said peripheral face, each sector being independent from the other sectors, an annular baseplate composed of several segments joined together and defining a reference surface, said baseplate facing said shell and spaced radially inwardly therefrom such that a gap is formed between an external diameter of said baseplate and an internal diameter of said shell, said baseplate being maintained in position with respect to said shell by adjustment elements located within said gap and engaging an external surface of said baseplate and an internal surface of said shell, a remaining portion of said gap defined between the shell, the baseplate and the adjustment elements being filled by cast metal that is poured into said gap in a molten state, the baseplate having holes which match said set of fixing holes of the peripheral face of the sectors, bolts passing through said fixing holes and the holes in the baseplate respectively, such that said framework is rigidly joined to said base plate, and means for rigidly fastening the baseplate to the shell.

2. The combination according to claim 1, wherein the holes in the baseplate are tapped holes in which said bolts are fixed, heads of the bolts lying outside the shell.

3. The combination according to claim 2, wherein the tapped holes in the baseplate are formed by internally threaded pieces which are received and remain fixed within larger holes in said baseplate.

4. The combination according to claim 1, wherein the baseplate consists of a rolled steel sheet having corrosion resistance.

5. The combination according to claim 1, wherein the baseplate is totally protected by the peripheral face of the sectors and by grilles and lining plates associated with said sectors.

* * * * *